United States Patent [19]

Rus et al.

[11] Patent Number: 4,481,917

[45] Date of Patent: Nov. 13, 1984

[54] ROTARY VALVE FOR INTERNAL-COMBUSTION ENGINE

[75] Inventors: Harald Rus, Rosenberggürtel 35, 8010 Graz; Georg Enzinger, Graz, both of Austria

[73] Assignee: Harald Rus, Graz, Austria

[21] Appl. No.: 524,296

[22] Filed: Aug. 18, 1983

[30] Foreign Application Priority Data

Aug. 18, 1982 [AT] Austria ..... 3128/82

[51] Int. Cl.[3] ..... F01L 7/04

[52] U.S. Cl. ..... 123/190 C; 123/190 B

[58] Field of Search ..... 123/190 B, 190 BD, 190 BA, 123/190 BF, 190 C, 190 R

[56] References Cited

U.S. PATENT DOCUMENTS

| | | | |
|---|---|---|---|
| 1,817,624 | 8/1931 | Higley | 123/190 C |
| 2,401,932 | 6/1946 | Heintz | 123/190 C |
| 3,948,241 | 4/1976 | Melchior | 123/190 C |

FOREIGN PATENT DOCUMENTS

| | | | |
|---|---|---|---|
| 184777 | 6/1955 | Austria . | |
| 307158 | 8/1972 | Austria . | |
| 678268 | 7/1939 | Fed. Rep. of Germany . | |
| 483896 | 10/1916 | France | 123/190 C |
| 21317 | of 1909 | United Kingdom | 123/190 C |
| 19791 | of 1911 | United Kingdom | 123/190 C |
| 151994 | 4/1922 | United Kingdom . | |
| 221841 | 9/1924 | United Kingdom | 123/190 C |
| 284941 | 2/1928 | United Kingdom | 123/190 B |

*Primary Examiner*—Ronald H. Lazarus

*Attorney, Agent, or Firm*—Karl F. Ross; Herbert Dubno

[57] ABSTRACT

A cylinder head of an internal-combustion engine, operating with the four-strike Otto cycle, has a pair of diametrically opposite outlet ports and a pair of diametrically opposite inlet ports offset by 90° from each other. Two coaxial annular shutters in the cylinder head, corotating with a speed ratio of 2:1, have each two mutually opposite solid quadrants and two intervening quadrants with valve apertures registering with the outlet ports and then with the inlet ports in two angular positions of the slower-rotating shutter spaced 45° apart, both pairs of ports being blocked during the next quarter-turn of this shutter. A flow divider in the cylinder head directs richer components of an aspirated fuel/air mixture toward a spark plug while leaner components are diverted toward an associated piston head.

16 Claims, 12 Drawing Figures

ROTARY VALVE FOR INTERNAL-COMBUSTION ENGINE

FIELD OF THE INVENTION

Our present invention relates to a rotary valve for a piston cylinder of an internal-combustion engine provided with one or more such cylinders operating in either a 2-stroke or a 4-stroke cycle.

BACKGROUND OF THE INVENTION

An operating cycle of such an engine, as is well known in the art, consists of four phases which in the 4-stroke Otto cycle correspond to respective piston strokes, namely an intake phase for the aspiration of an explosive air/fuel mixture, a compression and ignition phase, an expansion or power phase and an exhaust phase. Conventional rotary valves comprise a pair of shutters driven by the engine to rotate in close contact with each other about a common axis in synchronism with the reciprocation of the associated piston, these shutters being provided with respective apertures which register with each other during the exhaust phase and during the immediately following intake phase to unblock first an outlet port and then an inlet port of the corresponding cylinder. See, for example, British Pat. No. 151,994; reference may also be made to German Pat. No. 678,268 and to Austrian Pat. Nos. 184,777 and 307,158.

It is convenient to install such a rotary valve directly in the cylinder head, with its shutters centered on the cylinder axis, but this creates certain problems concerning the location and the size of the inlet and outlet ports which on the one hand should have a large enough cross-section to handle the aspirated and expelled gas masses and on the other hand should be sufficiently spaced apart to minimize thermal interaction. The valve apertures of the shutters registering with the outlet port in the exhaust phase and with the inlet port in the intake phase must, of course, also be so dimensioned as not unduly to throttle the gas flow during these two phases.

OBJECTS OF THE INVENTION

Thus, an object of our present invention is to provide a rotary valve which, on being mounted in a cylinder head, satisfies these desiderata.

Another object of our invention, designed to improve the performance of a spark plug used to ignite the combustible mixture, is to provide means in such a valve for stratifying that mixture to direct richer components thereof toward the spark plug during the intake phase.

SUMMARY OF THE INVENTION

A rotary valve according to our invention comprises a first and a second annular shutter each having two mutually opposite solid quadrants and two perforated intervening quadrants, these shutters being so driven by the engine—generally from the piston-operated crankshaft as known per se—that the first shutter performs half a revolution per cycle while the second shutter performs a full revolution at the same time. The cylinder head has a pair of diametrically opposite outlet ports and a pair of diametrically opposite inlet ports offset by 90° from one another, the two outlet ports registering with aligned apertures in the perforated quadrants of the shutters during the exhaust phase whereas the two inlet ports register with such aligned apertures during the immediately following intake phase. During the remaining two phases (compression/ignition and expansion) both pairs of ports are obstructed by the solid quadrants of at least one shutter.

If the more slowly rotating first shutter is the outer one, its valve apertures may include a pair of leading apertures registering with the inlet ports during the intake phase and a pair of trailing apertures registering with the outlet ports during the exhaust phase. Two solid sectors lying between adjacent leading and trailing apertures further contribute to the thermal separation of the inlet and outlet ports.

In any event, we prefer to dimension the apertures of both shutters in such a manner that the inlet ports of the cylinder head are unblocked immediately after a blocking of its outlet ports; this eliminates any intervening dead period, particularly in a 4-stroke cycle.

Pursuant to another feature of our invention, all the ports of a cylinder head and all apertures of the associated rotary valve lie in a common plane with a spark plug to which the incoming gas mixture may be fed, advantageously by way of a concave guide surface promoting stratification, directly or via a flow divider which lets heavier and therefore richer components of the mixture, aspirated through the aligned apertures of the shutters during the intake phase, pass by inertia toward the spark plug while lighter components are deflected toward the receding piston and thus into the combustion chamber bounded thereby. The flow divider may form concave passages that confront the inlet ports at least during the intake phase, allowing some of the heavier components to be centrifugally driven toward the spark plug.

BRIEF DESCRIPTION OF THE DRAWING

The above and other features of our invention will now be described in detail with reference to the accompanying drawing in which.

SPECIFIC DESCRIPTION

Figure 1:
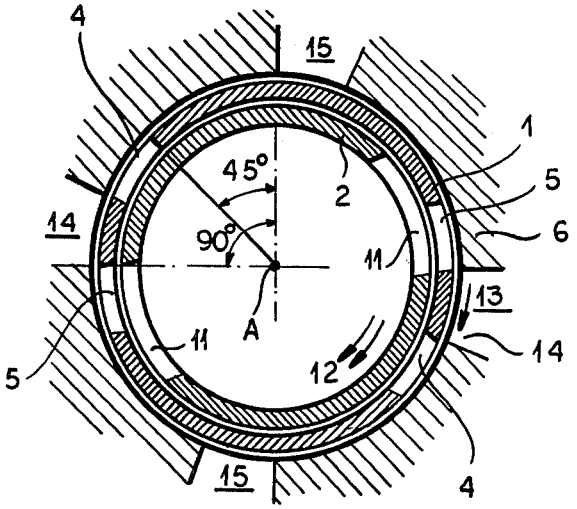
FIGS. 1–4 are cross-sectional views of a rotary valve according to our invention, shown in four different operating positions.

In FIGS. 1–4 we have shown part of a cylinder head 6 of an internal-combustion engine, centered on an axis A (see also FIGS. 11 and 12), having a pair of diametrically opposite outlet ports 14 and a pair of diametrically opposite inlet ports 15, the four ports being spaced 90° apart. A circular recess of cylinder head 6 accommodates two nested annular shutters 1 and 2. The outer ring 1 is in close contact with the inner ring 2 and with the surrounding cylinder wall; intervening annular gaps seen in the drawing have been exaggerated for the sake of clarity and are occupied by an oil film.

Each shutter may be considered divided into four quadrants, two of them (diametrically opposite each other) being solid while the other two are perforated. The perforations of shutter 1 comprise two diametrically opposite leading apertures 4 and two diametrically opposite trailing apertures 5 with centerlines spaced 45° apart as particularly indicated in FIG. 2; each of these apertures extends over 22.5° and so do the intervening solid sectors of their respective quadrants. The inner shutter 2 has two diametrically opposite apertures 11 spanning 45° each. The two shutters are codirectionally rotated about axis A by the internal-combustion engine of which cylinder head 6 forms part, e.g. in the manner described hereinafter with reference to FIGS. 10–12.

As symbolized by a double arrow 12 and a single arrow 13, shutter 2 rotates at twice the speed of shutter 1 so as to perform a full revolution during the four phases of an operating cycle represented by FIGS. 1–4. FIG. 1 illustrates the beginning of an exhaust phase in which trailing apertures 5 of shutter 1 are about to unblock the outlet ports 14 while registering with apertures 11 of shutter 2. In the middle of this phase, with shutters 1 and 2 having respectively rotated through 22.5° and 45°, valve apertures 5 and 11 are fully aligned with ports 14 to form a virtually unobstructed channel for the escape of spent gases to an exhaust. A further rotation through the same angles establishes the position of FIG. 2 which represents the beginning of an intake phase; trailing apertures 5 have just left the outlet ports 14 while leading apertures 4 are about to unblock the inlet ports 15 connected to a nonillustrated source of fuel/air mixture. In the middle of this intake phase, i.e. after a further rotation of shutters 1 and 2 by 22.5° and 45°, respectively, apertures 4 and 11 register fully with ports 15 to provide a virtually unobstructed channel for the influx of this mixture. The end of this phase establishes the position of FIG. 3 in which ports 14 and 15 are all unblocked by solid portions of both shutters 1 and 2. The ports remain obstructed during the immediately following compression phase, at the end of which the aspirated mixture is ignited in a combustion chamber of the piston cylinder adjoining the interior of shutter 2, and in the ensuing expansion or power phase beginning with the position of FIG. 4. The cycle is then repeated.

Figure 2:
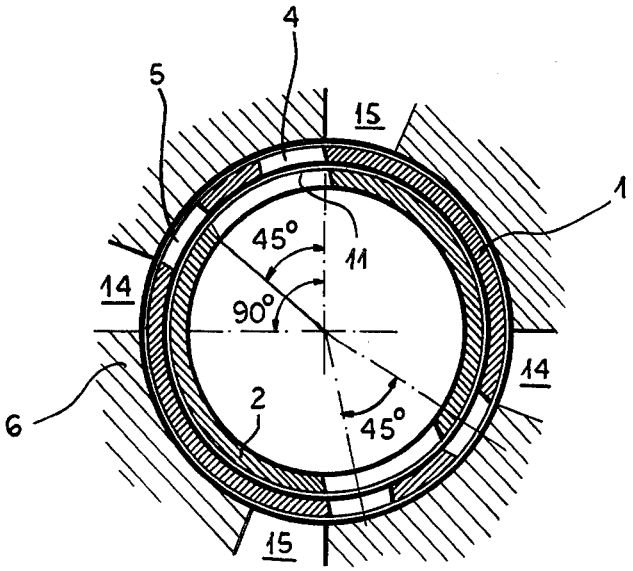
Figure 3:
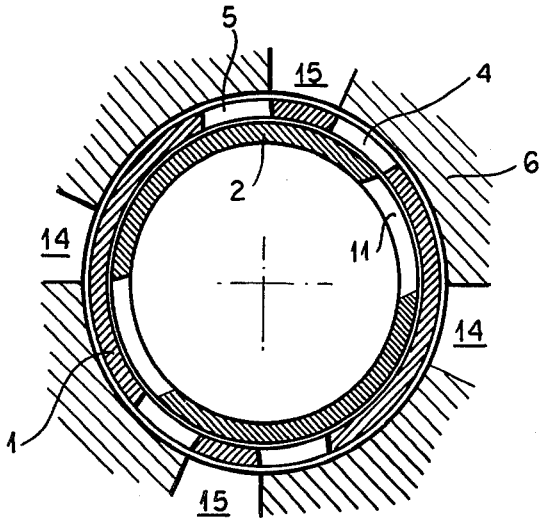
Figure 4:
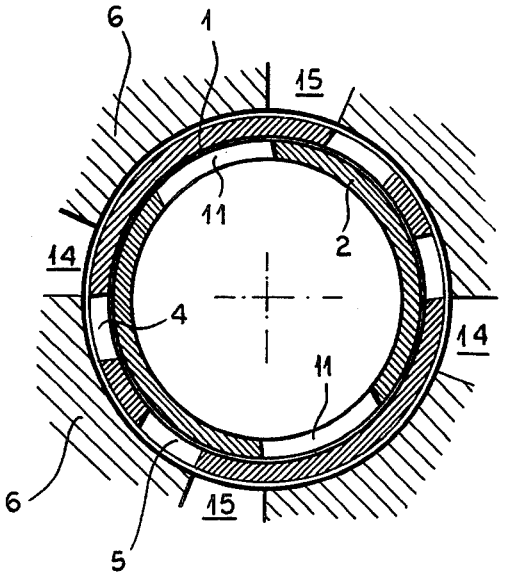
Figure 12:
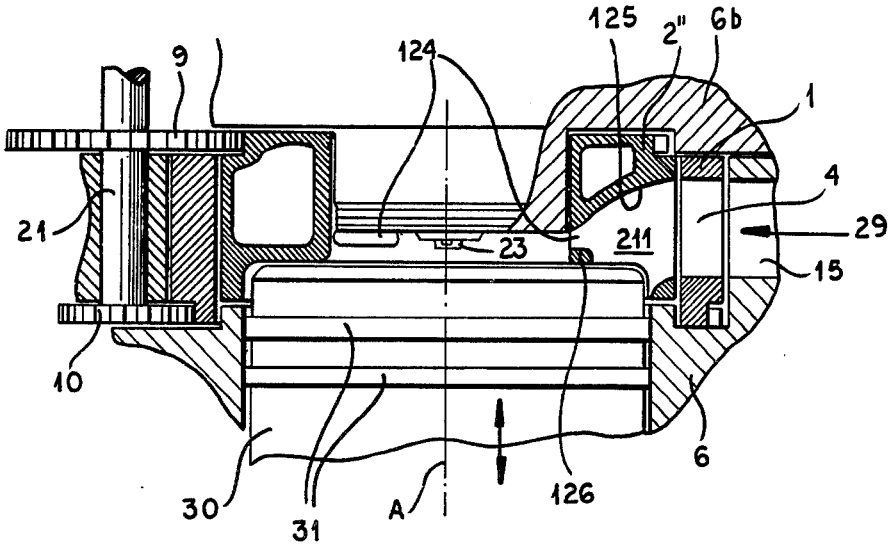
FIG. 12 is a view similar to FIG. 11, illustrating another modification.

When the engine operates according to the 4-stroke Otto cycle, its piston 30 (see FIGS. 11 and 12) begins to approach the cylinder head 6 in the positions of FIGS. 1 and 3 and begins to recede from it in the positions of FIGS. 2 and 4, Each piston stroke, therefore, corresponds to a 45° turn of shutter 1 and a 90° turn of shutter 2. The combustion chamber may have a diameter slightly less than the outer diameter of shutter 2, as also seen in FIGS. 11 and 12.

Figure 5:
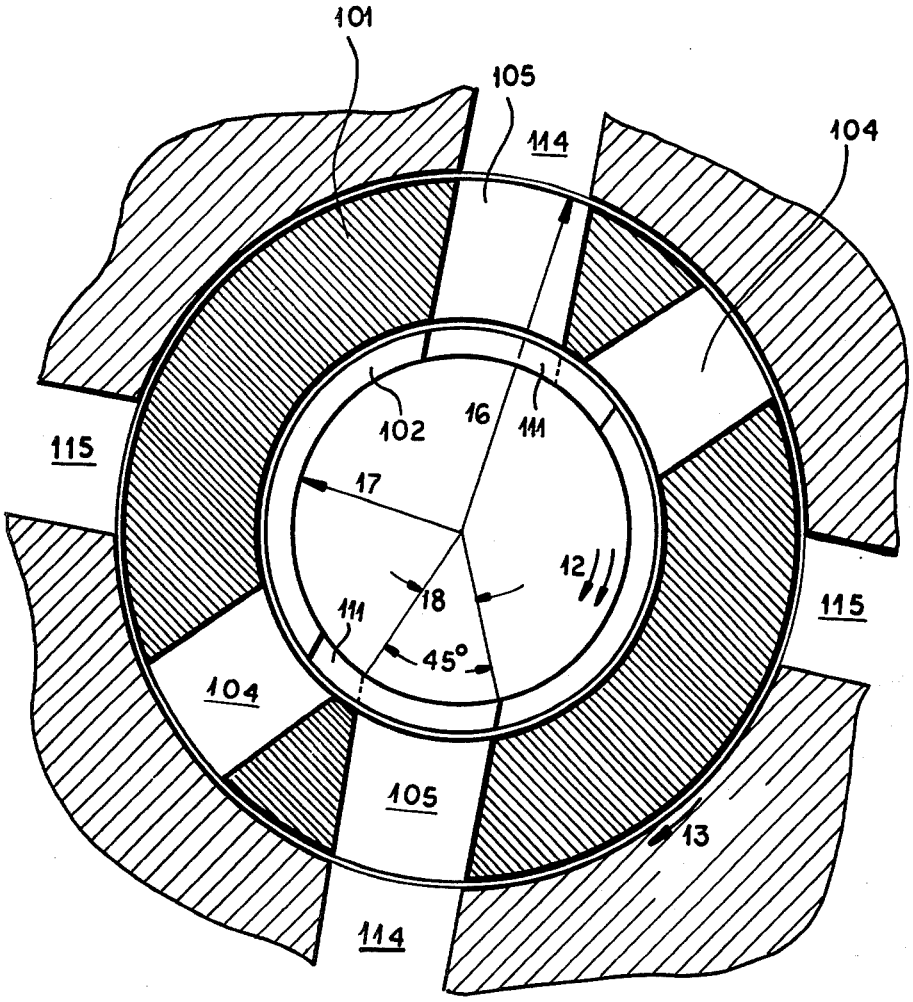
FIG. 5 is a view similar to FIGS. 1–4, showing a modified valve.

As will be apparent from the drawing, the angular extent of apertures 11 of shutter 2 could be increased beyond 45° without unblocking ports 14 and 15 in the interval between the positions of FIGS. 3 and 1. FIG. 5, in fact, shows a modification of the valve of FIGS. 1–4 with an outer shutter 101 and an inner shutter 102 having apertures 104, 105 and 111, respectively, the latter having a width well in excess of 45°. Whereas in the preceding embodiment the radial thicknesses of the two shutters were about equal and amounted to only a small fraction of the radius of each shutter, the outer ring 101 of FIG. 5 is substantially four times as thick as the inner ring 102. The outer radius 16 of ring 101 is about twice the inner radius 17 of ring 102 and their combined axial thickness is approximately equal to radius 17. Apertures 104 and 105, whose cross-section is constant throughout the thickness of shutter 101, are therefore widely separated at the outer periphery of this shutter though closely approaching each other at its inner periphery. With the cross-sectional areas of apertures 104 and 105 corresponding to those of outlet ports 114 and inlet ports 115, spent gases escape virtually unthrottled through apertures 105, 111 aligned with ports 114 in the position of FIG. 5; a similarly unobstructed entrance path is formed in an alternate position of shutters 101 and 102, respectively offset by 45° and 90° from those shown in FIG. 5, via ports 115 aligned with apertures 104 and 111. With shutter 102 assumed to have inner and outer diameters equal to those of shutter 2 in FIGS. 1–4, the increased thickness of shutter 101 results in a wider spacing of ports 114 and 115 from one another and thus in greater thermal separation of their flow paths. The angular extent of each aperture 104, 105 (as well as of the intervening solid sectors) at the outer periphery of shutter 101 is about 22.5°, as in the preceding embodiment.

Figure 6:
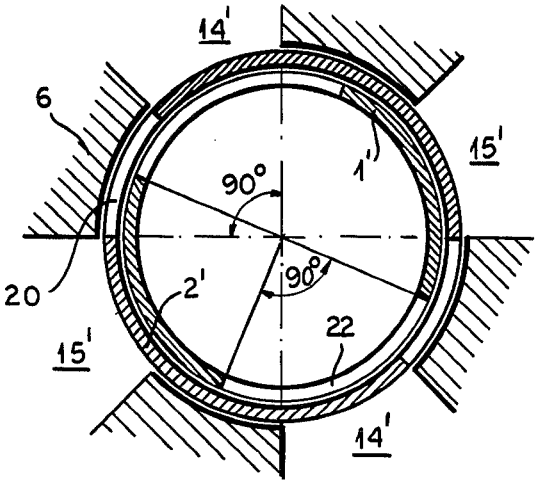
FIGS. 6–9 are four views respectively corresponding to FIGS. 1–4 but relating to a different embodiment.
Figure 7:
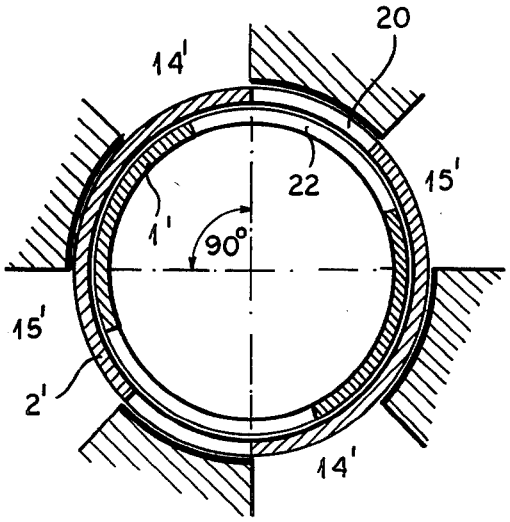
Figure 8:
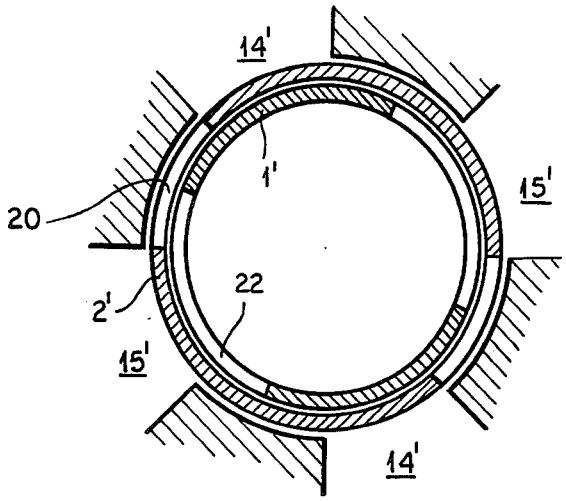
Figure 9:
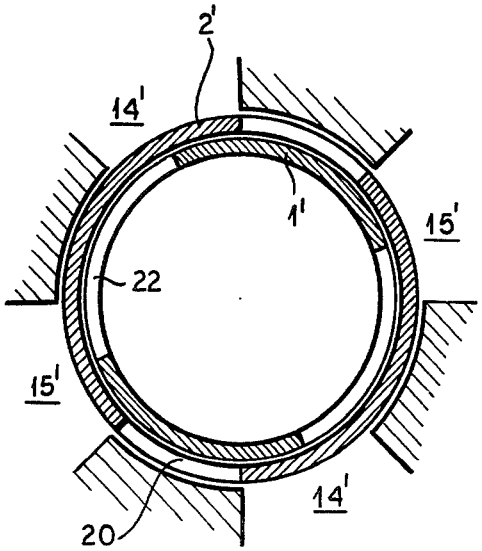

FIGS. 6–9 represent an inversion according to which an inner shutter 1' rotates at half the speed of an outer shutter 2', the latter having just one pair of diametrically opposite valve apertures 20 which extend over 45° and register with 90° apertures 22 of shutter 1' in an exhaust phase and in an intake phase respectively beginning in the positions of FIGS. 6 and 7. Outlet ports 14' and inlet ports 15', which are respectively unblocked by the aligned valve apertures in these two phases, are blocked in the other two phases, i.e. in a compression/ignition phase beginning with the position of FIG. 8 and in an expansion or power phase beginning with the position of FIG. 9. The peripheral width of each port in this embodiment, corresponding to that of apertures 20, is twice that of FIGS. 1–4, namely 45°.

Figure 10:
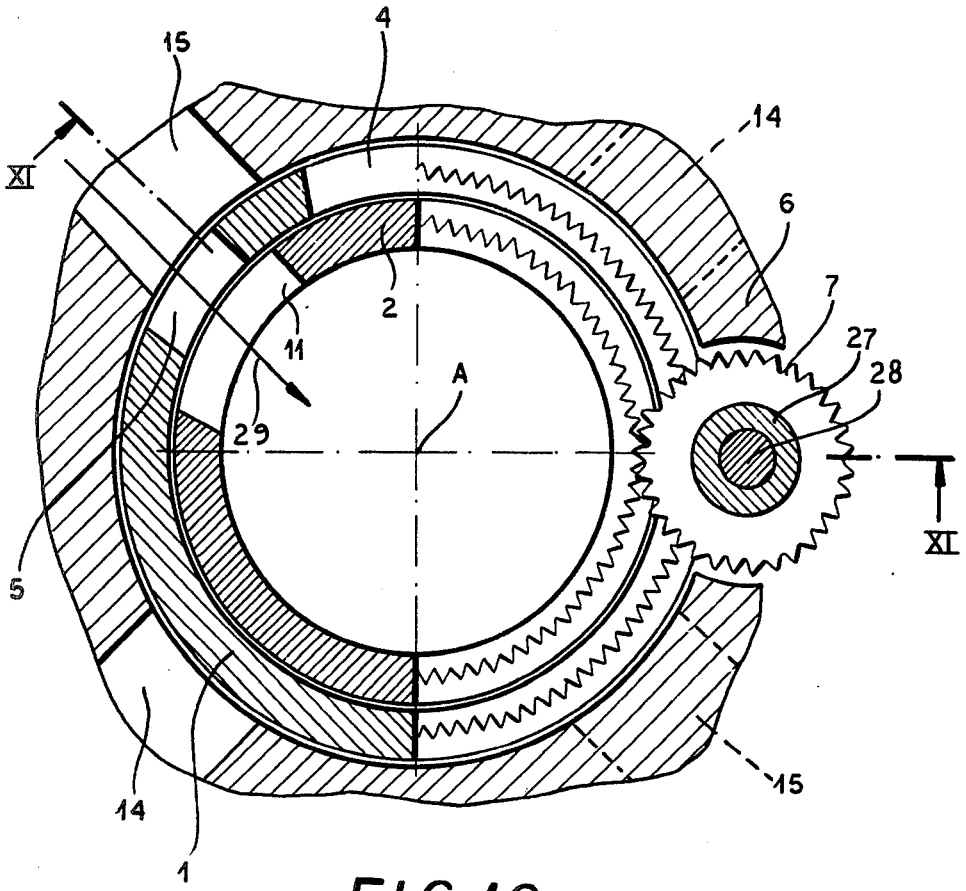
FIG. 10 is a cross-sectional view of a valve according to FIGS. 1–4, showing additional details.
Figure 11:
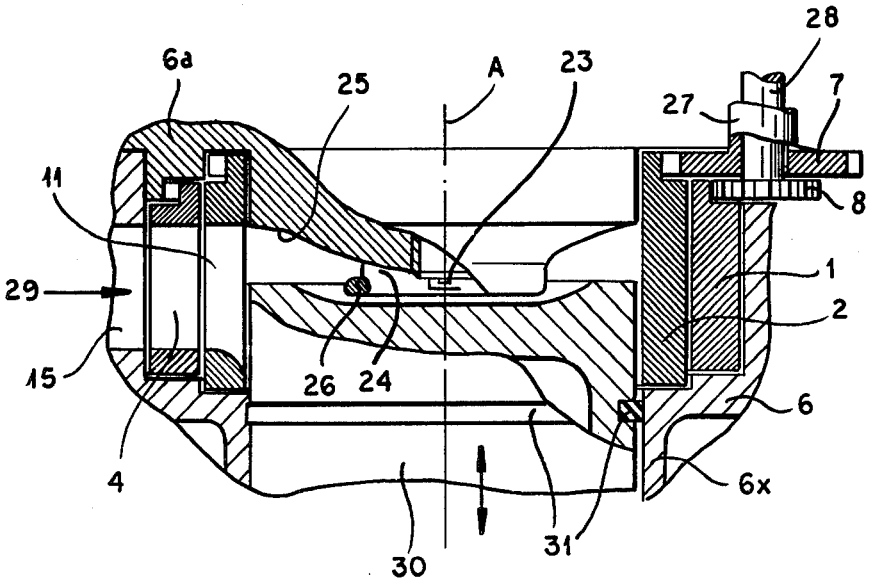
FIG. 11 is an axial sectional view taken on the line XI—XI of FIG. 10.

FIGS. 10 and 11 show a pair of pinions 7 and 8 respectively meshing with outer gear teeth on shutters 1 and 2 to drive them with the speed ratio of 1:2 described in connection with FIGS. 1–4. Pinions 7 and 8 are axially mounted on a pair of nested shafts 27, 28 which are driven, via a suitable transmission, at the requisite speeds by a nonillustrated crankshaft coupled with the rod of piston 30 reciprocating in a cylinder 6x integral with head 6. The head of piston 30 is shown provided with at least one packing ring 31 sealing the aforementioned combustion chamber against the outside, this chamber being in constant communication with apertures 11 of the inner shutter 2. With proper dimensioning of pinions 7 and 8, they could also be mounted on a single shaft as illustrated at 21 in FIG. 12 for a pair of similar pinions 9 and 10.

As seen in FIG. 11, cylinder head 6—which has a cutout accommodating the pinions 7 and 8—is provided with a detachable lid 6a overlying the shutters 1 and 2. This lid has a concave underside 25 which encircles a spark plug 23 and projects into the interior of shutter ring 2 so as to deflect the incoming gas mixture, represented by an arrow 29 in FIGS. 10 and 11, toward the top of piston 30. The heavier components of that mixture, however, continue centrifugally toward an annular flow divider 26 forming two passages 24 (only one shown) in line with inlet ports 15; in the intake-phase position of FIGS. 10 and 11, therefore, some of these heavier components can reach the spark plug 23 by way of the passages 24 whereas the lighter components bypass the divider 26. Even if this divider were omitted, however, a certain stratification would take place in the interior of shutter 2.

In FIG. 12 we have shown an assembly differing from that of FIGS. 10 and 11 (apart from pinions 9 and 10) by the substitution of an inner shutter 2'' of considerably larger radial thickness for the shutter 2. Shutter 2'', whose peripheral wall is preferably hollow as shown, is integral with a flow divider 126 forming passages 124 which are permanently aligned with two diametrically opposite valve apertures 211 (only one shown) and thus communicate with ports 15, via apertures 4 of outer shutter 1, during the intake phase. Apertures 211, which may be horizontally elongated, have concave surfaces 125 that terminate at passages 124 and, as described with reference to surface 25 of FIG. 11, deflect the lighter components of the incoming gas mixture toward piston 30 while letting the heavier components move by inertia—i.e. under centrifugal force—toward spark plug 23. Rings 1 and 2'' are held in position by a lid **6*b* detachable from cylinder head 6**.

It will be evident that shutters 101 or 102 of FIG. 5 or 1', 2' of FIGS. 6–9 could be driven by pinions in the manner illustrated for shutters 1 and 2 (or 2'') in FIGS. 10–12 and that stratification means including deflectors and flow dividers as shown in these Figures are also usable with rotary valves so modified.

The timing of the operating phases of the described rotary valve with reference to the reciprocation of the associated piston can be readily varied, in a manner known per se, by adjusting the coupling between the shaft or shafts of pinions 7–10 and the crankshaft driving same, e.g. with the aid of interposed differential gearing.

We claim:

1. In an internal-combustion engine having a piston cylinder with a cylinder head operable in a multistroke cycle, the combustion therewith of a rotary valve driven by the engine and located in said cylinder head, said rotary valve comprising a first and a second annular shutter coaxially corotating in close contact with each other and having each two mutually opposite solid quadrants and two perforated intervening quadrants, said first shutter being synchronized with a reciprocating piston in said cylinder to perform half a revolution per cycle and being provided in the intervening quadrants thereof with first apertures registering with a pair of diametrically opposite outlet ports in said cylinder head during an exhaust phase and with a pair of diametrically opposite inlet ports in said cylinder head during an immediately following intake phase of the piston, said second shutter being synchronized with said piston to perform a full revolution per cycle and being provided in the intervening quadrants thereof with second apertures registering with said outlet and inlet ports during said exhaust and intake phases, respectively, said inlet ports communicating with a source of fuel/air mixture and being offset by 90° from said outlet ports, said inlet and outlet ports being obstructed during a compression/ignition phase and during a subsequent expansion phase by the solid quadrants of at least one of said shutters.

2. The combination defined in claim 1 wherein said first shutter surrounds said second shutter.

3. The combination defined in claim 2 wherein said first apertures include a pair of leading apertures registering with said inlet ports during said intake phase and a pair of trailing apertures registering with said outlet ports during said exhaust phase, said leading and trailing apertures being separated from one another by solid sectors of said first shutter.

4. The combination defined in claim 3 wherein said solid sectors extend along the outer periphery of said first shutter over an arc substantially equaling the peripheral extent of said leading and trailing apertures.

5. The combination defined in claim 4 wherein said leading and trailing apertures closely approach each other along the inner periphery of said first shutter and are of substantially constant width.

6. The combination defined in claim 5 wherein said second shutter has a radial thickness equal to about a fourth of the radial thickness of said first shutter.

7. The combination defined in claim 3 wherein said leading and trailing apertures have centerlines including an angle of 45° with each other.

8. The combination defined in claim 7 wherein said second apertures extend each over 45°.

9. The combination defined in claim 1 wherein said first and second apertures are dimensioned to unblock said inlet ports immediately upon blocking said outlet ports.

10. The combination defined in claim 9 wherein said second shutter surrounds said first shutter, said first and second apertures extending each over 90° and 45°, respectively.

11. The combination defined in claim 1 wherein said shutters are provided with external gear teeth meshing with respective pinions driven by the engine.

12. The combination defined in claim 11 wherein said pinions are coaxially disposed in a cutout of said cylinder head.

13. The combination defined in claim 1 wherein said cylinder is provided with a spark plug projecting into a combustion chamber bounded by the piston and in communication with the apertures of the inner one of said shutters, said spark plug being located in a common plane with all said apertures and ports.

14. The combination defined in claim 13, further comprising a flow divider in said cylinder head defining passages that confront said inlet ports at least during said intake phase for letting heavier components of said mixture, aspirated through the aligned apertures of said shutters along a concave deflecting surface, pass inertially toward said spark plug while lighter components of said mixture are deflected by said guide surface toward the piston.

15. The combination defined in claim 14 wherein said flow divider is rigid with said cylinder head.

16. The combination defined in claim 14 wherein said flow divider is mounted on the inner one of said shutters.

* * * * *